US008622879B1

(12) United States Patent
Ihli et al.

(10) Patent No.: US 8,622,879 B1
(45) Date of Patent: Jan. 7, 2014

(54) EXERCISE SHOE METHODS AND APPARATUS

(76) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 471 days.

(21) Appl. No.: 12/927,255

(22) Filed: Nov. 10, 2010

Related U.S. Application Data

(60) Provisional application No. 61/281,017, filed on Nov. 12, 2009.

(51) Int. Cl.
*A63B 21/02* (2006.01)
*A43B 23/00* (2006.01)

(52) U.S. Cl.
USPC ..... 482/124; 482/127; 36/136

(58) Field of Classification Search
USPC ..... 482/1–148; 36/136
See application file for complete search history.

(56) References Cited

U.S. PATENT DOCUMENTS 766,743 A 8/1904 Terry
913,799 A 3/1909 Burguet
1,390,095 A * 9/1921 Dettinger et al. ..... 607/78
1,573,362 A * 2/1926 Stovall ..... 482/148
1,954,762 A * 4/1934 Wolff ..... 482/127
2,214,052 A * 9/1940 Good ..... 482/105
2,951,702 A * 9/1960 Goodwin ..... 482/127
2,959,414 A * 11/1960 Saltz ..... 482/127
3,841,627 A * 10/1974 Vetter ..... 482/110
3,885,789 A * 5/1975 Deluty et al. ..... 482/120
4,174,832 A * 11/1979 Thompson ..... 482/120
4,196,903 A * 4/1980 Illustrato ..... 482/77
4,328,965 A * 5/1982 Hatfield ..... 482/122
4,523,582 A * 6/1985 Barber ..... 602/36
4,625,962 A * 12/1986 Street ..... 482/116
4,779,866 A * 10/1988 Marshall et al. ..... 482/116
4,948,119 A * 8/1990 Robertson, Jr. ..... 482/56
5,226,867 A * 7/1993 Beal ..... 482/127
5,324,243 A * 6/1994 Wilkinson ..... 482/92
5,358,461 A * 10/1994 Bailey, Jr. ..... 482/2
5,437,591 A * 8/1995 Chen ..... 482/127
5,486,149 A * 1/1996 Smith et al. ..... 482/120
5,509,873 A * 4/1996 Corn ..... 482/74
5,618,249 A * 4/1997 Marshall ..... 482/127
5,709,637 A * 1/1998 Gow et al. ..... 482/129
5,722,919 A * 3/1998 Timmer ..... 482/79
5,733,231 A * 3/1998 Corn et al. ..... 482/120
5,755,646 A * 5/1998 Chu ..... 482/118
5,792,034 A * 8/1998 Kozlovsky ..... 482/124
5,876,310 A * 3/1999 Mackey et al. ..... 482/74
5,935,047 A * 8/1999 Cawley ..... 482/79
6,094,844 A * 8/2000 Potts ..... 36/136
6,099,447 A * 8/2000 Ramsaroop ..... 482/127
6,149,559 A * 11/2000 Mackey ..... 482/124
6,283,897 B1 * 9/2001 Patton ..... 482/79

(Continued)

OTHER PUBLICATIONS

U.S. Appl. No. 12/927,252, Portable Exercise Apparatus and Methods.

(Continued)

*Primary Examiner* — Stephen Crow

(57) ABSTRACT

Exercise shoe assemblies include a shoe body, at least one support bracket integrated into the shoe body, and a resistance device connected to the support bracket. The resistance device preferably includes a flexible member, and may include a housing from which the flexible member is extracted.

21 Claims, 10 Drawing Sheets

(56) References Cited

U.S. PATENT DOCUMENTS

| | | | | |
|---|---|---|---|---|
| 6,283,899 | B1 * | 9/2001 | Charnitski | 482/110 |
| 6,312,361 | B1 * | 11/2001 | Hayes | 482/51 |
| 6,315,701 | B1 * | 11/2001 | Shifferaw | 482/114 |
| 6,544,152 | B2 * | 4/2003 | Rosati | 482/126 |
| 6,551,225 | B1 * | 4/2003 | Romero | 482/146 |
| 6,629,698 | B2 * | 10/2003 | Chu | 280/11.19 |
| 6,726,607 | B1 * | 4/2004 | Ihli | 482/127 |
| 6,770,014 | B2 * | 8/2004 | Amore | 482/92 |
| 7,087,001 | B1 * | 8/2006 | Ihli | 482/115 |
| 7,250,021 | B2 * | 7/2007 | Leight | 482/116 |
| 7,322,909 | B1 * | 1/2008 | Loccarini et al. | 482/129 |
| 7,618,356 | B1 * | 11/2009 | Johnson et al. | 482/124 |
| 7,794,368 | B2 * | 9/2010 | Rutherford | 482/79 |
| 7,833,137 | B2 * | 11/2010 | Garnuette | 482/79 |
| 7,892,154 | B1 * | 2/2011 | Alexa | 482/112 |
| 2003/0211920 | A1 * | 11/2003 | Mandel | 482/116 |
| 2004/0204302 | A1 * | 10/2004 | Flynn | 482/124 |
| 2004/0209739 | A1 * | 10/2004 | Lammers | 482/51 |
| 2006/0040805 | A1 * | 2/2006 | Wilkinson | 482/124 |
| 2007/0010380 | A1 * | 1/2007 | Wilkinson | 482/124 |
| 2007/0060454 | A1 * | 3/2007 | Vogel | 482/121 |

OTHER PUBLICATIONS

U.S. Appl. No. 12/927,253, Exercise Resistance Methods and Apparatus.
U.S. Appl. No. 12/927,254, Exercise Methods and Apparatus.
U.S. Appl. No. 12/927,255, Exercise Shoe Methods and Apparatus.
U.S. Appl. No. 12/927,256, Golf Exercise Methods and Apparatus.
U.S. Appl. No. 12/927,257, Exercise Apparatus and Methods.

* cited by examiner

Fig. 3
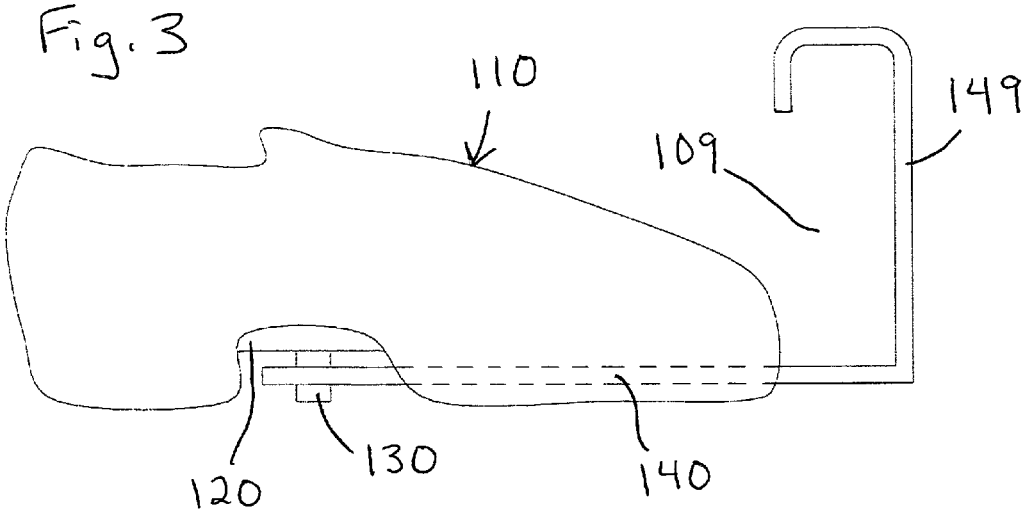
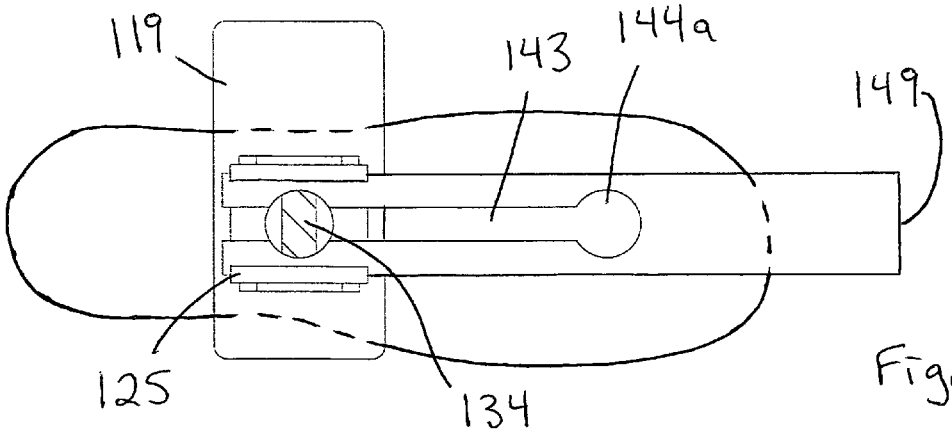
Fig. 4

EXERCISE SHOE METHODS AND APPARATUS

CROSS-REFERENCE TO RELATED APPLICATION

Disclosed herein is subject matter that is entitled to the filing date of U.S. Provisional Application No. 61/281,017, filed Nov. 12, 2009.

FIELD OF THE INVENTION

The present invention relates to exercise methods and apparatus, and more specifically, to connecting exercise apparatus to a person's shoe(s).

BACKGROUND OF THE INVENTION

An object of the present invention is to connect exercise devices to a person's shoes.

SUMMARY OF THE INVENTION

According to one aspect of the present invention, an exercise shoe assembly includes a shoe body; at least one support bracket integrated into the shoe body; and a resistance device connected to the support bracket. According to another aspect of the present invention, a person selectively connects a resistance device to her foot and performs a first exercise by extracting a flexible member from the resistance device, and the person alternatively removes the resistance device from her foot and performs a second exercise by extracting a flexible member from the resistance device. Additional features and advantages of the present invention will become apparent from the more detailed description that follows.

BRIEF DESCRIPTION OF THE DRAWING

With reference to the Figures of the Drawing, wherein like numerals represent like parts and assemblies throughout the several views:

FIG. 3 is a side view of components of the exercise shoe assembly of FIG. 1 in an alternative configuration;

FIG. 4 is a bottom view of components of the exercise shoe assembly of FIG. 1 in the alternative configuration of FIG. 3;

DETAILED DESCRIPTION OF THE PREFERRED EMBODIMENT

Figure 1:
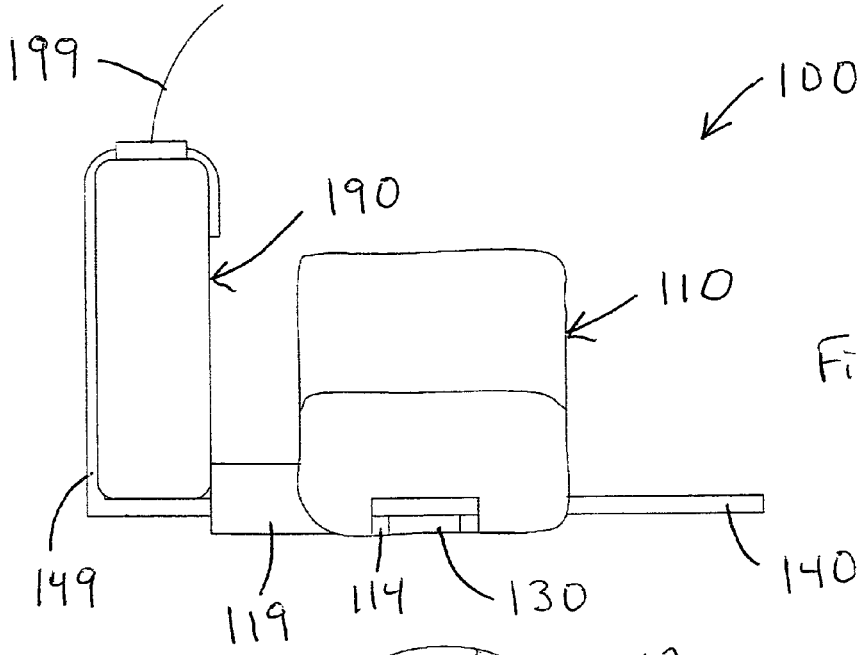
FIG. 1 is a front view of an exercise shoe assembly constructed according to the principles of the present invention.
Figure 2:
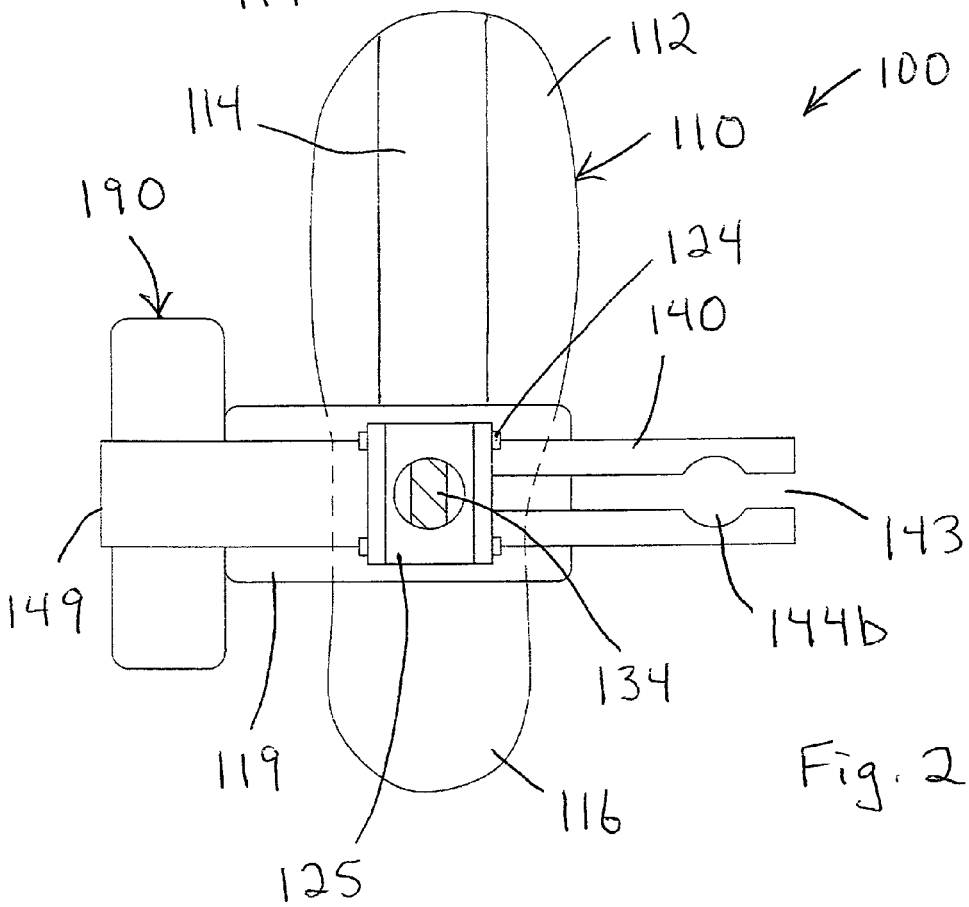
FIG. 2 is a partially sectioned bottom view of the exercise shoe assembly of FIG. 1.

A first exercise shoe assembly constructed according to the principles of the present invention is designated as 100 in FIGS. 1-2. Various components of the shoe assembly 100 are shown in FIGS. 2-6. The shoe assembly 100 includes a shoe body 110, at least one support bracket 120 integrated into the shoe body 110, and a resistance device 190 connected to the support bracket 120 (via additional components).

Figure 5:
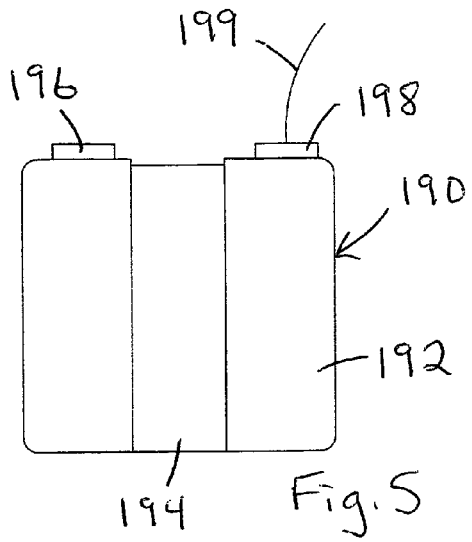
FIG. 5 is a front view of a resistance device from the exercise shoe assembly of FIG. 1.
Figure 6:
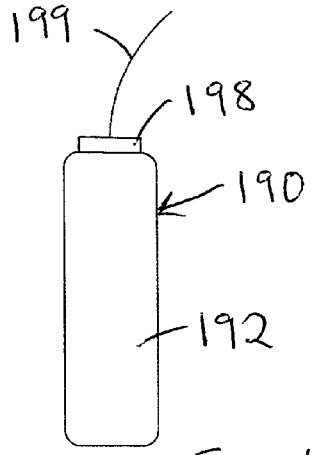
FIG. 6 is an end view of the exercise resistance device of FIG. 5.

The resistance device 190 is shown by itself in FIGS. 5-6. The resistance device 190 is similar in many respects, including certain aspects of construction, operation, and use, to the devices disclosed in U.S. Pat. No. 6,726,607 to Ihli, and U.S. Pat. No. 7,087,001 to Ihli, both of which are incorporated herein by reference. However, persons skilled in the art will recognize that the resistance device 190 may operate in a totally different manner without departing from the scope of the present invention. For example, an alternative embodiment may be made with a scaled-down version of the isokinetic resistance device disclosed in U.S. Pat. No. 5,511,740 to Loubert et al., which is also incorporated herein by reference.

The resistance device 190 includes a housing 192 having a central channel 194 that extends vertically along the front and back sides and horizontally across the top side. An adjustment knob 196 is located on the top side to one side of the channel 194, and a re-directional bearing 198 is located on the top side on an opposite side of the channel 194. A flexible member or cable 199 extends from a distal end, disposed outside the housing 192, through the re-directional bearing 198, to an opposite end portion, wrapped about a sheave. A rewind spring is interconnected between the sheave and the housing 192 to encourage the flexible member 199 to wind onto the sheave. On the resistance device 190, a band brake arrangement resists removal of the flexible member 199 from the sheave. On other embodiments, different types of resistance arrangements may be used in the alternative.

The shoe body 110 includes a front portion 112, a heel portion 116, and an intermediate portion disposed therebetween. A downwardly opening channel 114 extends longitudinally along the front portion 112 to accommodate a removable bracket 140 in the configuration shown in FIGS. 3-4. The intermediate portion of the shoe body 110 includes a block 119 that is preferably an integral portion of the shoe body sole, and configured and arranged to support and/or accommodate other components of the shoe assembly 100.

A first channel bracket 124 is secured to a bottom side of the support bracket 120, and is configured and arranged to define a laterally extending channel. A second channel bracket 125 is secured to a bottom side of the first channel bracket 124, and is configured and arranged to define a longitudinally extending channel. A latch 130 is rotatably mounted on the support bracket 120, and extends to a lower distal end that is configured for rotation by a person's thumb and forefinger. The latch 130 includes an intermediate portion 134 having diametrically opposite first and second sides that are bounded by cylindrical surfaces, and diametrically opposite third and fourth sides that are bounded by planar surfaces.

The removable bracket 140 may be described as a flat steel bar that has been bent into a configuration having a straight first section and an inverted J-shaped second section 149 extending perpendicularly away from an end of the straight section. The J-shaped section 149 cooperates with a proximate portion of the straight section to receive the resistance device 190, and the segments of the J-shaped section 149 fit into respective portions of the channel 194 in the resistance device housing 192.

A slot 143 extends longitudinally into an opposite end of the straight section, and the slot 143 intersects two spaced apart circular holes 144*a* and 144*b* extending through respective portions of the straight section. The width of the slot 143 is wide enough to accommodate the intermediate portion 134 of the latch 130 when the flat sidewalls of the intermediate portion 134 extend parallel to the sidewalls of the slot 143, but not wide enough to accommodate the intermediate portion of the 134 of the latch 130 when the flat sidewalls of the intermediate portion 134 extend perpendicular to the sidewalls of the slot 143 (as shown in FIGS. 2 and 4). The diameter of each circular hole 144*a* and 144*b* is large enough to accommodate the intermediate portion 134 of the latch 130 in any orientation. As result, the latch 130 is rotatable to the orientation shown in FIG. 4 to accommodate sliding of the removable bracket 140 relative to the upper channel bracket 124, and to prevent sliding of the removable bracket 140 relative to the lower channel bracket 125. Similarly, the latch 130 is rotated to the orientation shown in FIG. 2 to prevent sliding of the removable bracket 140 relative to the upper channel bracket 124, and to accommodate sliding of the removable bracket 140 relative to the lower channel bracket 125.

FIGS. 1 and 2 show the removable bracket 140 inserted into the channel defined by the upper bracket 124, and secured in place by the latch 130. The block 119 on the shoe body 110 is configured and arranged to abut or bear against a proximate portion of the resistance device housing 192 when the hole 144*a* aligns with the latch 130, thereby encouraging the resistance device 190 to remain as shown relative to the removable bracket 140.

FIGS. 3 and 4 show the removable bracket 140 inserted into the channel defined by the lower bracket 124 (and the channel 114 in the shoe body 110), and secured in place by the latch 130. The front end of the front portion 112 is configured and arranged to abut or bear against a proximate portion of the resistance device housing 192 when the hole 144*b* aligns with the latch 130, thereby encouraging the resistance device 190 to remain secured in place relative to the removable bracket 140.

Components of another exercise shoe assembly constructed according to the principles of the present invention are shown in FIGS. 5-10. This alternative embodiment shoe assembly includes a shoe body 210, at least one support bracket 220 integrated into the shoe body 210, and a resistance device 190 connected to the support bracket 220 (via additional components).

The shoe body 210 includes a front portion 212, a heel portion 216, and an intermediate portion disposed therebetween. A downwardly opening channel 214 extends longitudinally along the front portion 212 to accommodate a removable bracket 240 in the configuration shown in FIGS. 7-8. The intermediate portion of the shoe body 210 includes a block 219 that is preferably an integral portion of the shoe body sole, and configured and arranged to support and/or accommodate other components of the shoe assembly. A downwardly opening channel 215 extends laterally across the block to accommodate the removable bracket 240 in the configuration shown in FIGS. 9-10.

The support bracket 220 may be described as a flat metal strip that is bent into a J-shaped configuration. The longer leg or end portion of the J-shaped bracket 220 is encapsulated in the sole of the heel portion 216, and the shorter leg or end portion of the J-shaped bracket 220 defines a square hub 224. A latch 230 is rotatably mounted on the bracket 220, preferably by means of a rivet or bolt. The latch 230 includes a lever portion having a first end that is captured in the gap between the legs of the bracket 220, and an opposite, second end that is configured and arranged to be rotated by a person's thumb and/or forefinger. The latch 230 also includes a lower end member 234 that defines a square similar in size to the hub 224.

The removable bracket 240 may be described as a flat steel bar that has been bent into a configuration having a straight first section and an inverted J-shaped second section 249 extending perpendicularly away from an end of the straight section. The J-shaped section 249 cooperates with a proximate portion of the straight section to receive the resistance device 190, and the segments of the J-shaped section 249 fit into respective portions of the channel 194 in the resistance device housing 192.

First and second square holes 244*a* and 244*b* extend through respective portions of the straight section. The dimensions of each hole 244*a* and 244*b* are large enough to accommodate the passage of the latch member 234 when the latch member 234 occupies the same orientation as the holes 244*a* and 244*b*. The dimensions of each hole 244*a* and 244*b* are also large enough to accommodate passage of the bracket leg 224 when the holes 244*a* and 244*b* occupy the same orientation as the bracket leg 224. As result, the latch 230 is rotatable forty-five degrees from the orientation shown in FIGS. 8 and 10 to accommodate insertion of the removable bracket 240 past the latch member 234 and onto the bracket leg 224, and the latch 230 is rotated to the orientation shown in FIGS. 8 and 10 to prevent removal of the removable bracket 240 from the support bracket 220.

Figure 7:
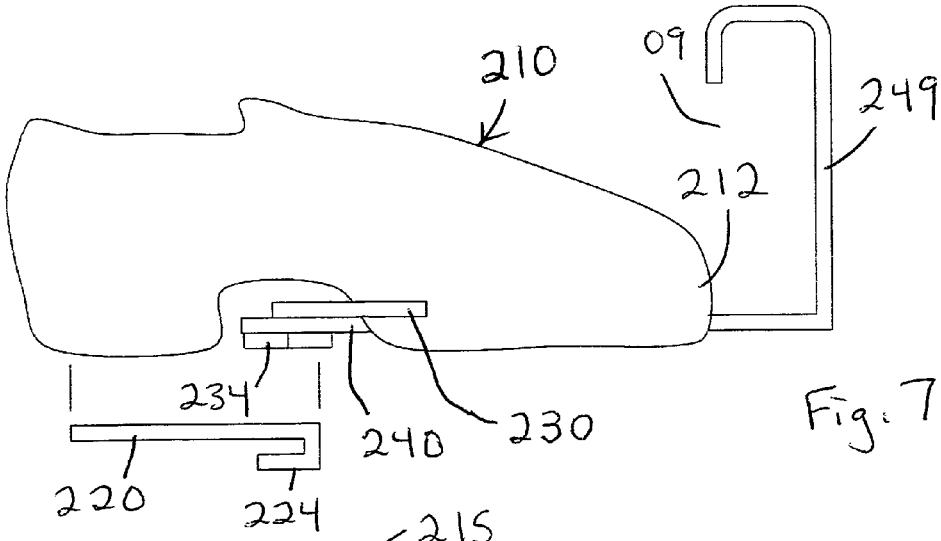
FIG. 7 is a side view of components of an alternative embodiment exercise shoe assembly that is suitable for use with the resistance device of FIGS. 5-6.
Figure 8:
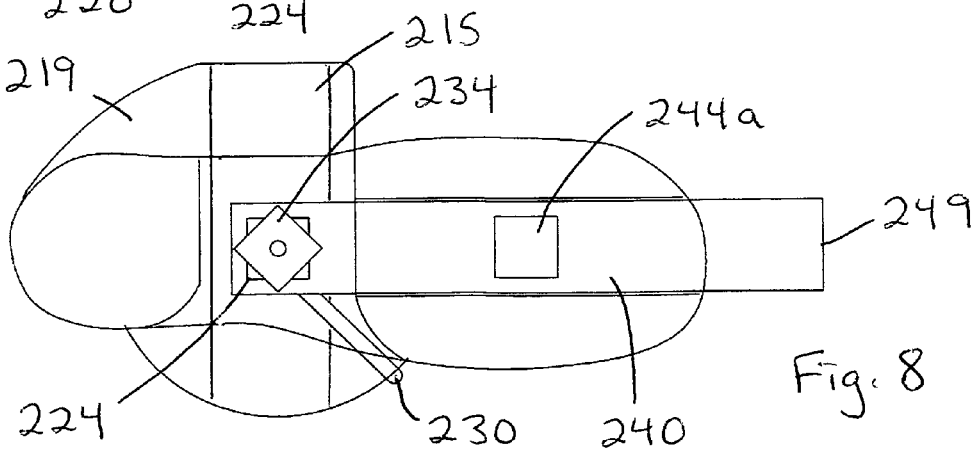
FIG. 8 is a bottom view of more components of the alternative embodiment exercise shoe assembly of FIG. 7.

FIGS. 7 and 8 show the removable bracket 240 inserted into the channel 214 in the shoe body 210, and secured in place by the latch 230. The front end of the front portion 212 is configured and arranged to abut or bear against a proximate portion of the resistance device housing 192 when the hole 244*b* aligns with the bracket leg 224, thereby encouraging the resistance device 190 to remain secure relative to the removable bracket 240.

Figure 9:
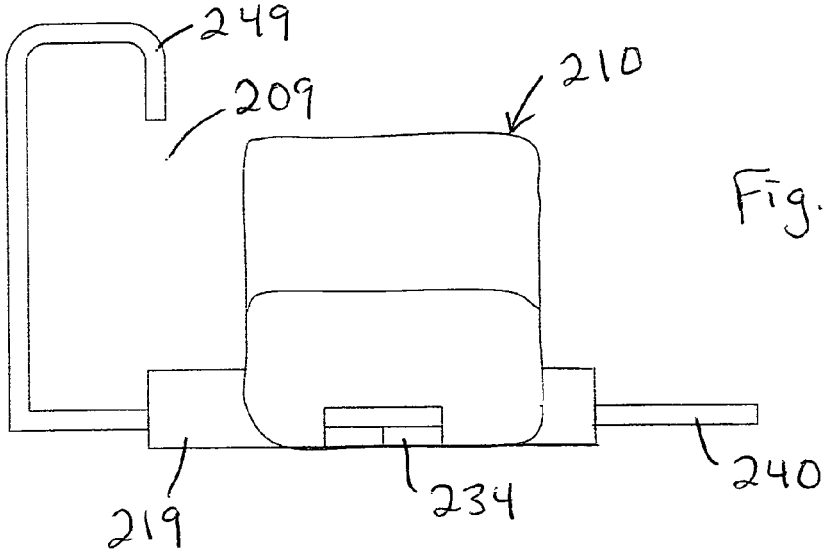
FIG. 9 is a front view of the components of FIG. 8 in an alternative configuration.
Figure 10:
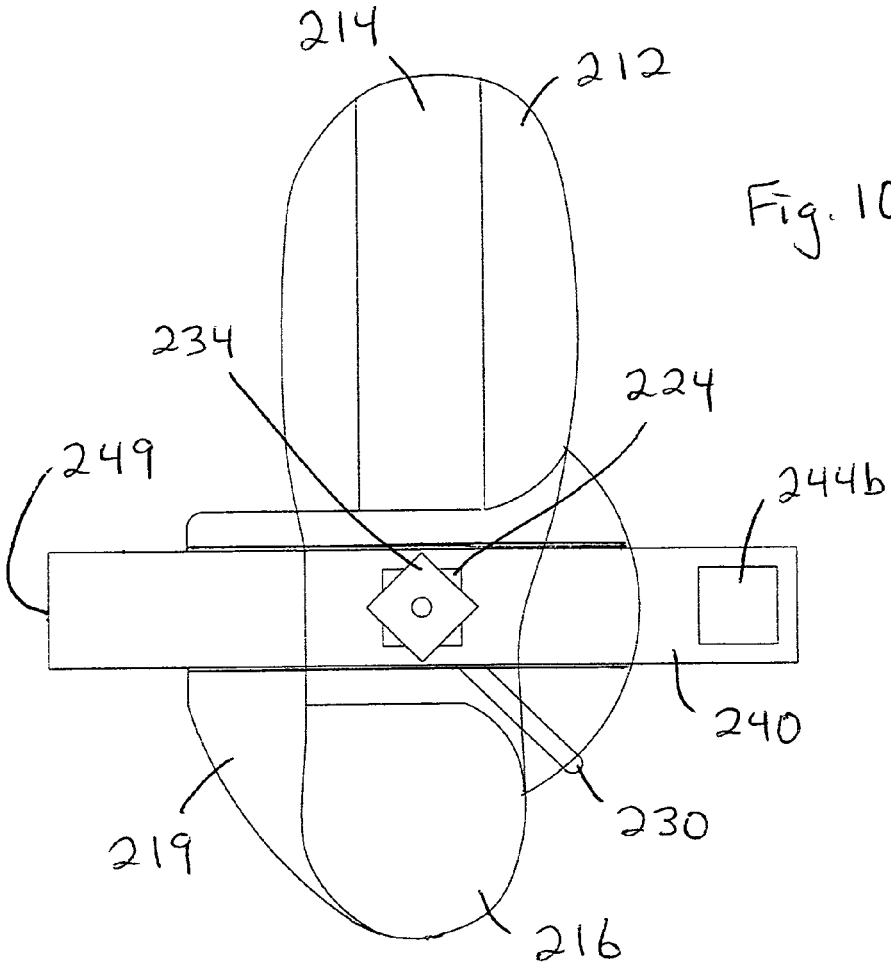
FIG. 10 is a bottom view of the components of FIG. 9 as configured in FIG. 9.
Figure 11:
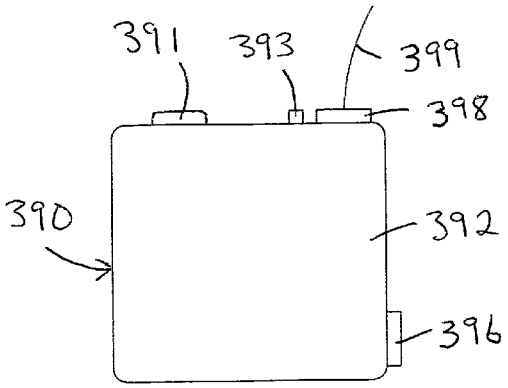
FIG. 11 is a front view of an alternative embodiment resistance device.
Figure 12:
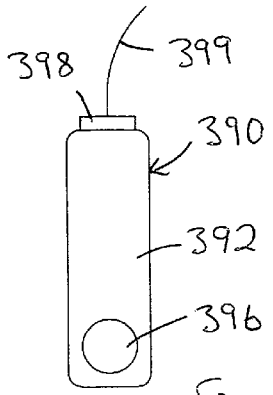
FIG. 12 is an end view of the resistance device of FIG. 11.
Figure 13:
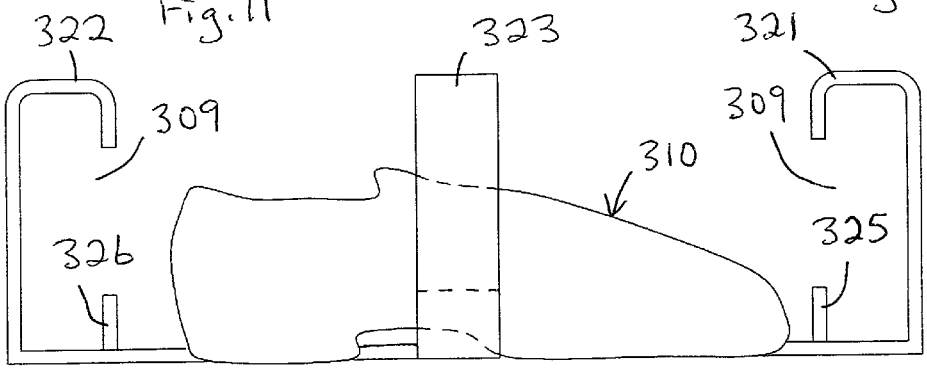
FIG. 13 is a side view of components of an alternative embodiment exercise shoe assembly that is suitable for use with the resistance device of FIGS. 11-12.
Figure 14:
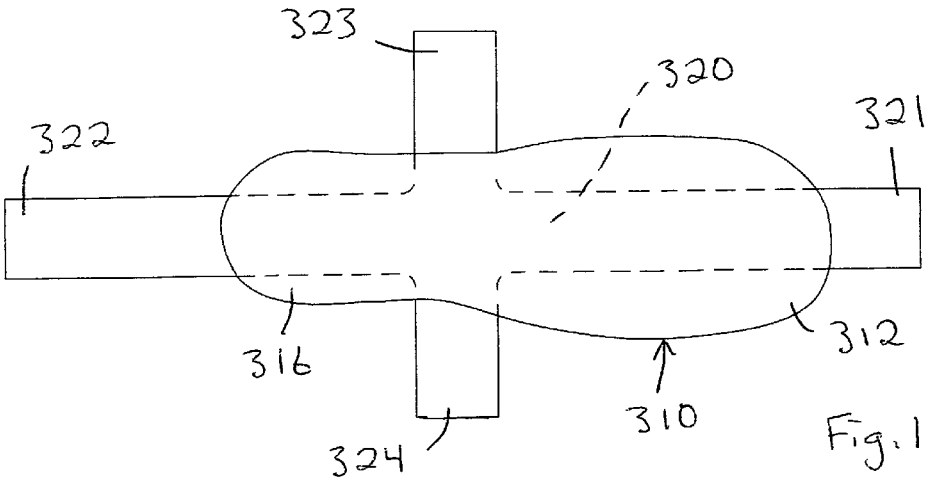
FIG. 14 is a bottom view of the exercise shoe assembly components of FIG. 13.
Figure 15:
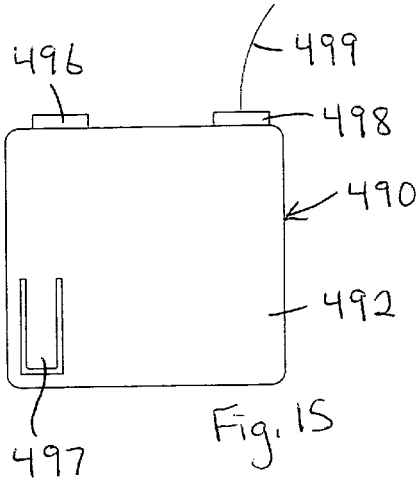
FIG. 15 is a front view of another alternative embodiment resistance device.
Figure 16:
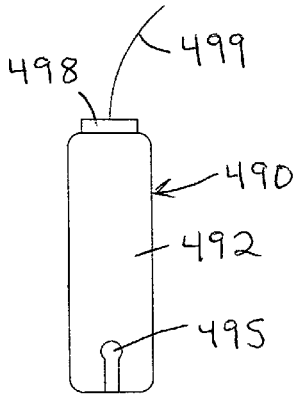
FIG. 16 is an end view of the resistance device of FIG. 15.
Figure 17:
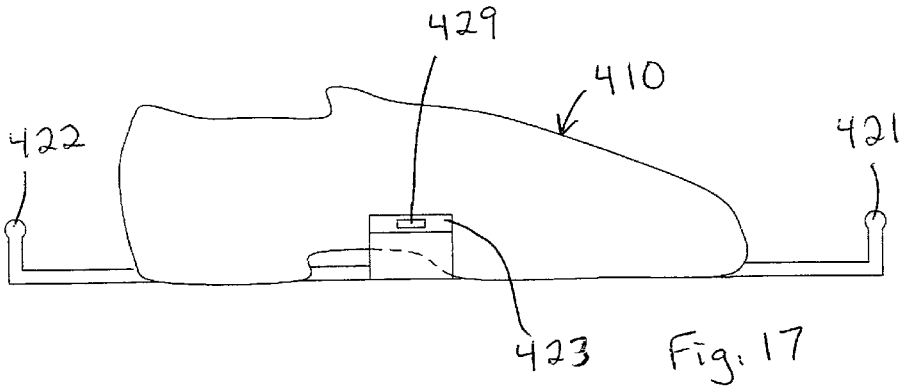
FIG. 17 is a side view of an alternative embodiment exercise shoe assembly that is suitable for use with the resistance device of FIGS. 15-16.
Figure 18:
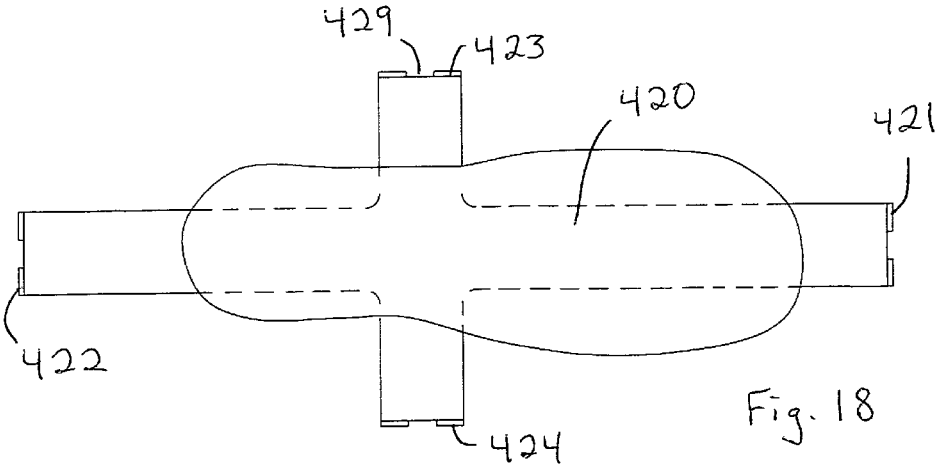
FIG. 18 is a bottom view of the exercise shoe assembly components of FIG. 13.

FIGS. 9-10 show the removable bracket 240 inserted into the channel 215 in the shoe body 210, and secured in place by the latch 230. The block 219 on the shoe body 110 is configured and arranged to abut or bear against a proximate portion of the resistance device housing 192 when the hole 244*a* aligns with the bracket leg 224, thereby encouraging the resistance device 190 to remain secure relative to the removable bracket 240.

Components of another exercise shoe assembly constructed according to the principles of the present invention are shown in FIGS. 11-14. This alternative embodiment shoe assembly includes a shoe body 310, at least one support bracket 320 integrated into the shoe body 310, and a resistance device 390 connected to the support bracket 320.

The resistance device 390 includes a housing 392 having a spring-loaded button or latch 391 projecting upward from an upper end of the housing 392, and a peg or stop 393 projecting upward from the upper end of the housing 392. A re-directional bearing 398 is also located on the upper end of the housing 392. A flexible member or cable 399 extends from a distal end, disposed outside the housing 392, through the re-directional bearing 398, to an opposite end portion, wrapped about a sheave. A rewind spring is interconnected between the sheave and the housing 392 to encourage the flexible member 399 to wind onto the sheave. On the resistance device 390, a band brake arrangement resists withdrawal of the flexible member 199 from the sheave, and a brake adjustment knob 396 is located on a lower sidewall of the housing 392 and operable to adjust resistance associated with the band brake arrangement.

The shoe body 310 includes a front portion 312, a heel portion 316, and an intermediate portion disposed therebetween. The support bracket 320 may be described as a t-shaped member having respective segments that extend longitudinally along the entire length of the shoe body 310, and laterally across the entire width of the shoe body 310. Outwardly projecting ends of the t-shaped member cooperate with respective tabs (two of which are designated as 325 and 326) to define respective C-shaped brackets 321-324.

Each C-shaped bracket 321-324 is configured to receive and retain the resistance device housing 392. In this regard, the button 391 is depressed to accommodate sliding of the housing 392 laterally into the channel 309 defined by a respective C-shaped bracket 321-324. When the peg 393 encounters an edge of the bracket 321-324, the button 391 is clear of an opposite edge of the bracket 321-324, thereby accommodating projection of the button 391 upward from the housing 392. The button 391 and the peg 393 cooperate to retain the upper segment of the C-shaped bracket 321-324 therebetween, and thereby prevent the resistance device 390 from sliding out of engagement with the bracket 321-324.

Components of another exercise shoe assembly constructed according to the principles of the present invention are shown in FIGS. 15-18. This alternative embodiment shoe assembly includes a shoe body 410, at least one support bracket 420 integrated into the shoe body 410, and a resistance device 490 connected to the support bracket 420.

The resistance device 490 includes a housing 492 having a leaf spring latch 497 incorporated into a lower corner portion of its front wall. A channel 495 projects into a lower portion of a sidewall on the housing 492 and intersects with a tab on the latch 497. The channel 495 may be described as having a keyhole-shaped cross-section. An adjustment knob 496 is located on the top side of the housing 492, generally above the latch 497, and a re-directional bearing 498 is located on an opposite end of the top side. A flexible member or cable 499 extends from a distal end, disposed outside the housing 492, through the re-directional bearing 498, to an opposite end portion, wrapped about a sheave. A rewind spring is interconnected between the sheave and the housing 492 to encourage the flexible member 499 to wind onto the sheave. On the resistance device 490, a band brake arrangement resists removal of the flexible member 499 from the sheave, and the adjustment knob 496 is rotated to adjust the resistance.

The shoe body 410 includes a front portion 412, a heel portion 416, and an intermediate portion disposed therebetween. The support bracket 420 may be described in terms of a t-shaped member having respective segments that extend longitudinally along the entire length of the shoe body 410, and laterally across the entire width of the shoe body 410. Outwardly projecting ends of the t-shaped member are bent upward and terminate in respective horizontally extending cylinders or rails 421-424. A laterally outwardly facing portion of each rail 421-424 is interrupted by a centrally located notch 429.

Each of the rails 421-424 is configured to receive and retain the resistance device housing 492. In this regard, the channel 495 is aligned with a desired rail 421-424 and urged onto the rail 421-424 until the leaf spring latch 497 deflects outward and then inward into the associated notch 429. The inwardly facing tab on the latch 429 cooperates with the sidewalls of the notch 429 to prevent the resistance device 490 from sliding off the rail 421-424.

Figure 20:
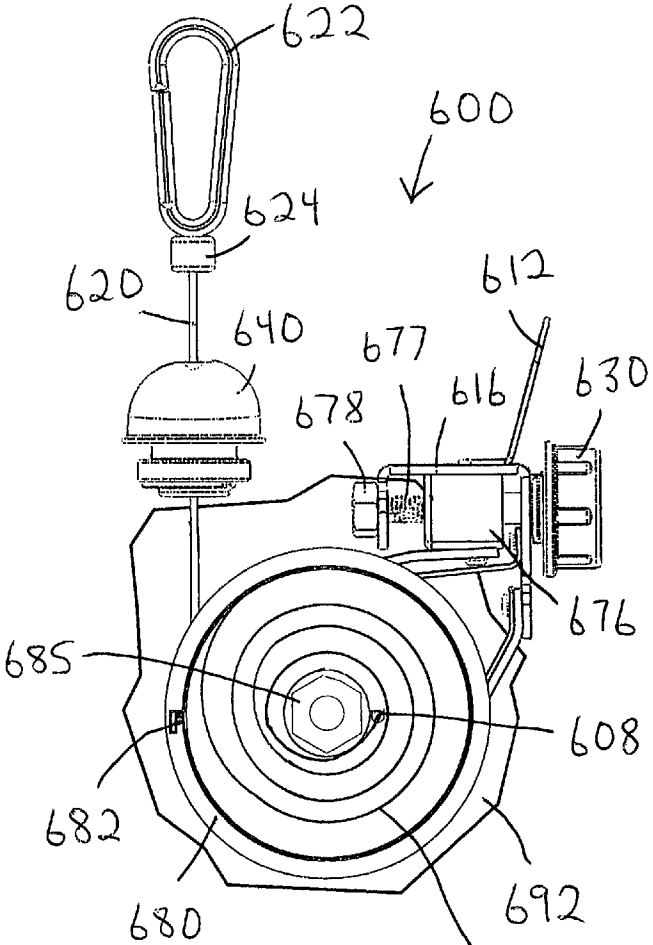
FIG. 20 is another partially sectioned front view of the resistance device components of FIG. 19.
Figure 19:
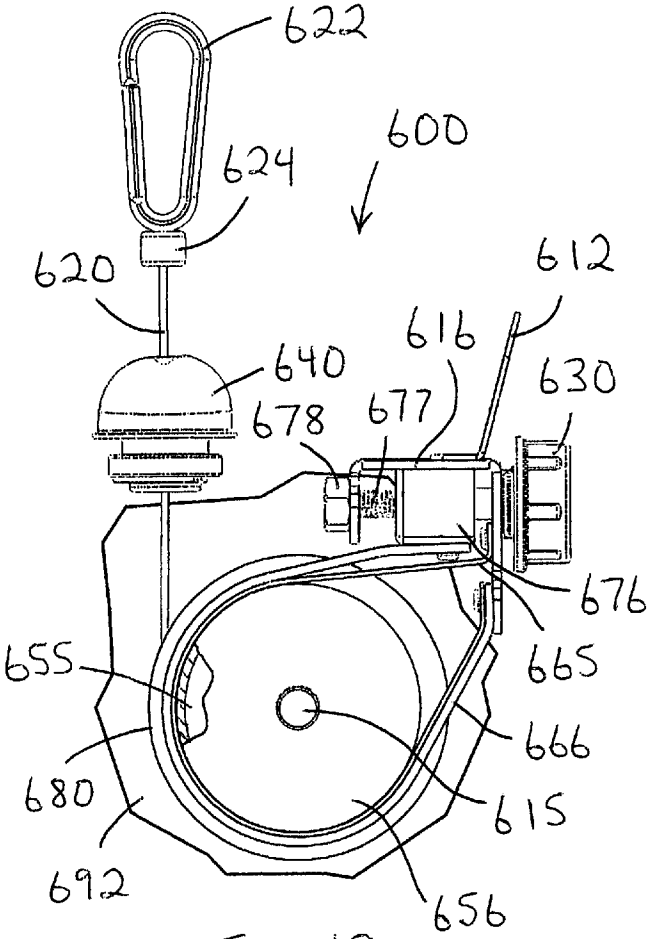
FIG. 19 is a partially sectioned front view of components similar to those inside the resistance device of FIGS. 11-12.

FIGS. 19-20 show components of a resistance device 600 that is suitable for use on the various shoe assemblies described above. In other words, the resistance device 600 includes a housing 692 that may be configured to take the same functional shape of any of the housings 192, 392, or 492. The resistance 600 also includes a flexible member or resistance cable 620 that is similarly extracted from the housing 692 when the extraction force exceeds an adjustable level of resistance, and that is similarly rewound into the housing 692 when tension in the cable 620 falls below the rewind force exerted by a spring within the housing 692.

As shown in FIG. 19, the cable 620 is wound about a sheave 680, which in turn, is mounted on a rotatable shaft 615 via a conventional one-way clutch bearing 685. A hub 655 is rigidly secured to the shaft 615, and a steel cylindrical cap 656 is rigidly mounted on the hub 655 to define a resistance drum. A stainless steel brake band 666 is secured about a portion of the cap 656 with a Kevlar brake strip sandwiched therebetween. The brake band 666 cooperates with the resistance drum to provide resistance to rotation of the shaft 615 in either direction.

As shown in FIG. 20, a coiled rewind spring 690 is nested within a compartment defined by the sheave 680. An inner end of the spring 690 is anchored to the housing 692 via a peg 608, and an opposite, outer end of the spring 690 is anchored to the sheave 680 via a flange 682. As a result, the spring 690 biases the sheave 680 to rotate in a first rotational direction relative to the shaft 615 and the housing 692. The sheave 680 rotates together with the shaft 615 and relative to the housing 692 in an opposite, second rotational direction in response to extraction of the cable 620. Thereafter, when the cable 620 is released, the rewind spring 690 rotates the sheave 680 relative to the shaft 615 to retract the cable 620 within the housing 692.

A knob 630 is rotatably mounted on an end of the housing 692, and rotates relative to the housing 692 to adjust the level of resistance associated with the resistance drum. The housing 692 includes a bracket or frame member 616 that is preferably a stamped metal part. The frame member 616 is preferably secured in place between opposing "halves" of the housing 692 by means of internal structure on the housing shells, as well as fasteners that secure the halves to one another. A first rivet or other suitable fastener secures a first end of the brake strip 665 to a first portion of the frame member 616. A second rivet or other suitable fastener secures an opposite, second end of the brake strip 665 to a discrete, second portion of the frame member 616. The second rivet also preferably secures an end of the tension band 666 to the second portion of the frame member 616.

An opposite end of the tension band 666 is secured to a slide block 676 by means of a separate fastener, which is preferably a screw. The slide block 676 is threaded onto a bolt 677, and the slide block 676 bears against the frame member 616 in a manner that prevents rotation while allowing linear travel of the former relative to the latter. The bolt 677 is rotatably mounted within upper and lower openings in the frame member 616. An upper end of the bolt 677 is keyed to the knob 630, and a lower end of the bolt 677 is rigidly fastened to a nut 678. A thrust bearing is preferably disposed between the knob 630 and the frame member 616 to accommodate relative rotation therebetween. The foregoing elements cooperate to rotatably mount the bolt 677 in a specific position relative to the frame. A lower end of the frame member 616 is configured and arranged to limit downward travel of the slide block 676 along the bolt 677. On an alternative embodiment, a pin or other suitable stop is preferably secured to a lower section of the bolt 677 to function as the stopping means.

When the knob 630 is rotated in a first direction, tension in the tension band 666 increases, and when the knob 630 is rotated in an opposite, second direction, tension in the tension band 666 decreases. In either case, tension in the brake material 665 remains relatively unaffected, while compression of the brake material 665 against the cap 656 increases or decreases in direct relation to the change in tension in the tension band 666. On a working embodiment of the device 600, the resulting resistance experienced by a user is smooth and predictable through a range of resistance from 2 to 40 pounds in response to less than two full rotations of the knob 630.

A re-directional bearing assembly 640 is movably mounted on top of the housing 692, and the cable 620 is routed through the re-directional bearing assembly 640 to accommodate extraction of the cable 620 in any direction having an upward component relative to the top of the housing 692. Persons skilled in the art will recognize that the re-directional bearing 640 is located at one of six available "corner locations" on the housing 692, and furthermore, that it need not occupy an orthogonal or parallel orientation relative to the longitudinal axis of the adjustment bolt 677.

A bead or stop 624 is rigidly secured to an external portion of the cable 620, and the bead 614 is too large to fit through the opening defined by the re-directional bearing assembly 640, thereby preventing the distal end of the cable 620 from becoming lost inside the housing 692. A carabineer clip 622 is connected to an outer distal end of the cable 620 to releasably connect the cable 620 to any of various force receiving members, including a conventional force receiving member, such as the handle shown in FIG. 11 of U.S. Pat. No. 7,087,001, for example.

Figure 21:
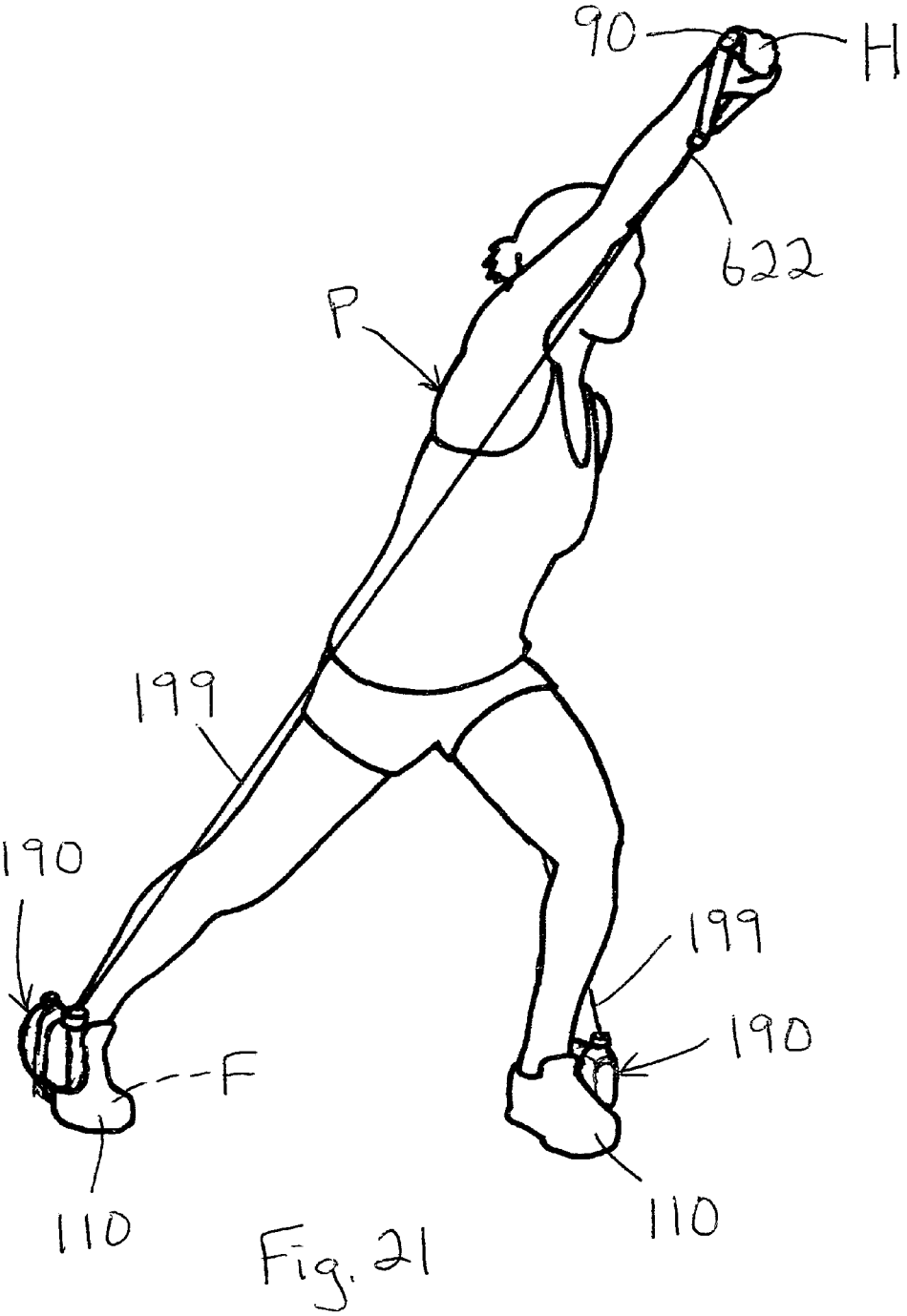
FIG. 21 is a perspective view of a person using two of the exercise shoe assemblies configured as shown in FIGS. 1-2.

FIG. 21 shows a person P exercising with an embodiment of the present invention. A separate resistance device 190 is connected to each foot via a respective shoe body 110, and a separate handle 90 is connected to each flexible member 199 via a respective carabineer 622. As suggested by the pose shown in FIG. 21, a wide range of exercise motions can be performed with a handle 90 in each hand H, and a resistance device 190 on each foot F.

Figure 22:
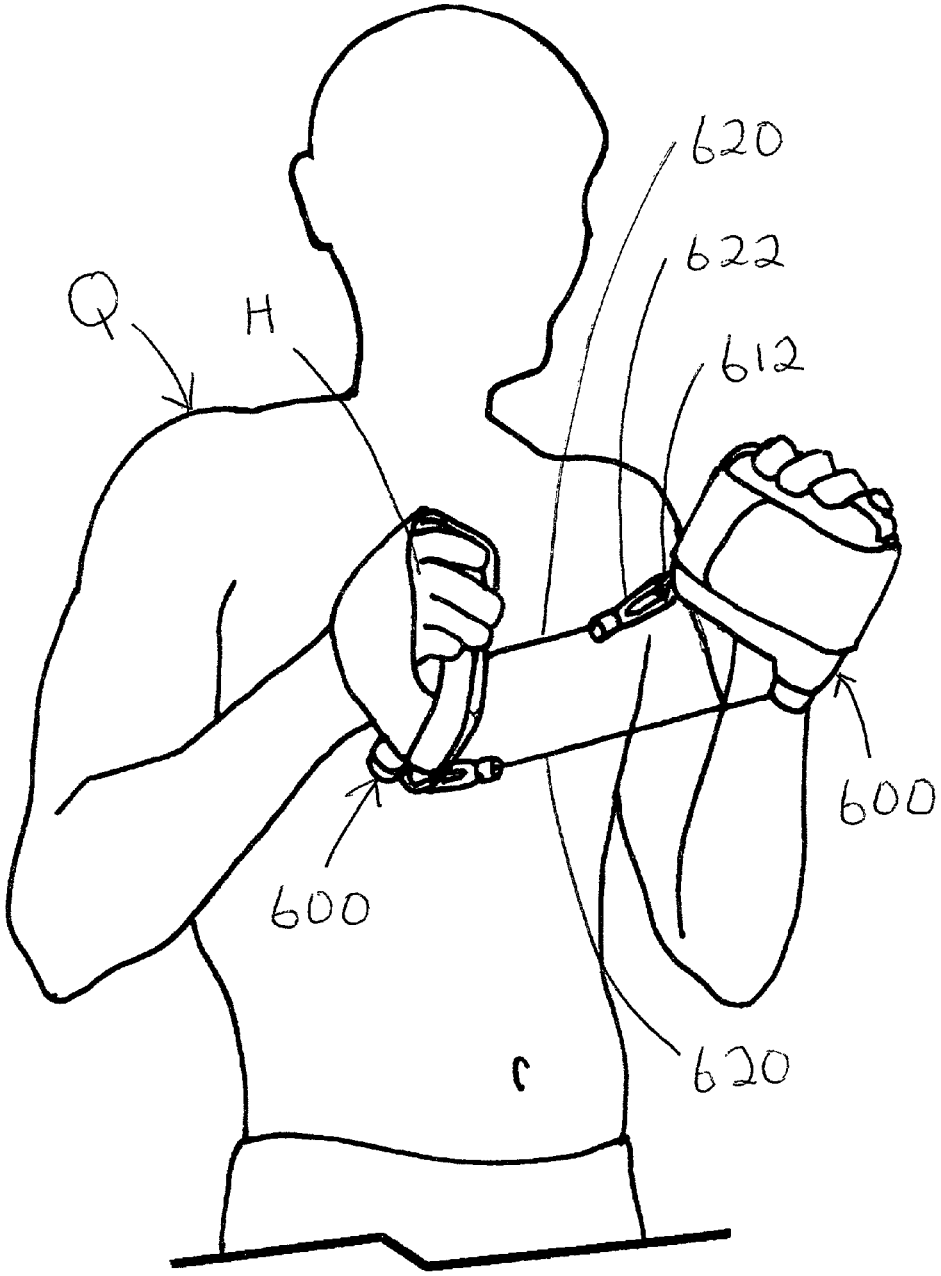
FIG. 22 is a perspective view of a person alternatively using two of the resistance devices of FIGS. 5-6 apart from any shoes.

As shown in FIG. 22, two resistance devices 600 may alternatively be connected to one another at respective attachment members 612. When held in respective hands H of a person Q and arranged as shown in FIG. 22, the resistance devices 600 may be used to perform alternative sorts of exercise, including upper rows, for example.

Figure 23:
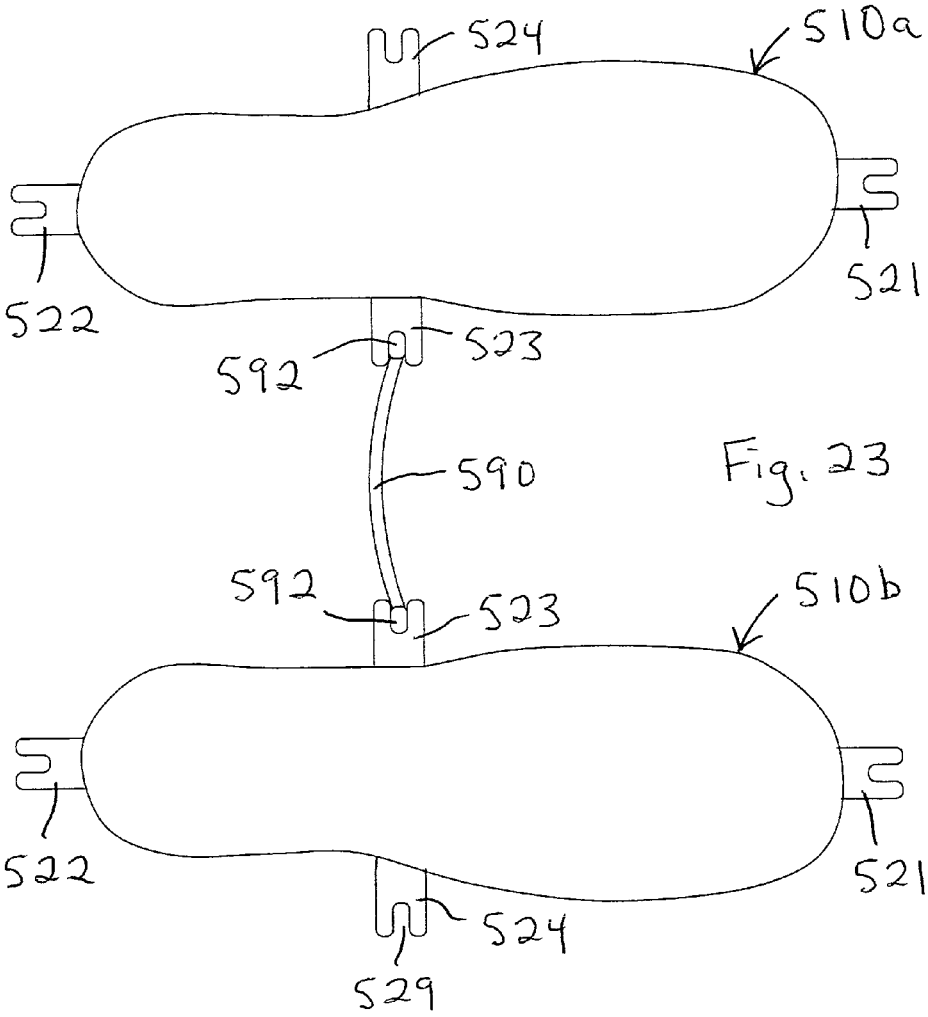
FIG. 23 is a top view of an alternative embodiment exercise shoe assembly that incorporates only some of the principles common to other embodiments of the present invention.
Figure 24:
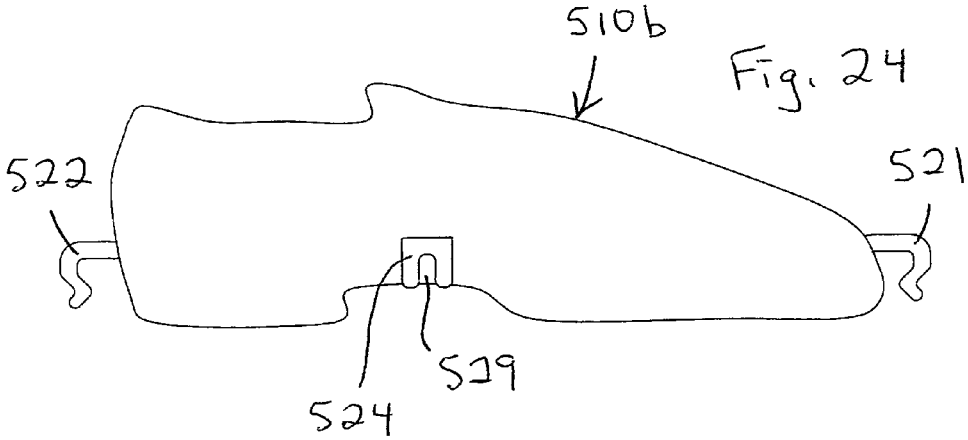
FIG. 24 is a side view of the exercise shoe assembly of FIG. 23.

FIGS. 23-24 show a pair of exercise shoe assemblies interconnected to one another. Each shoe assembly includes a shoe body 510*a* or 510*b*, at least one support bracket 521-524 integrated into the shoe body 510*a* or 510*b*, and a resistance device 590 connected to the support bracket 521-524.

The support brackets 521-524 may be integral portions of a unitary bracket like those shown on the previous two embodiments, or in the alternative, they may be separately integrated into discrete portions of the shoe body 510*a* or 510*b*. Each bracket 521-524 is configured to define a pair of downwardly curved prongs or hooks that define a gap or opening 529 therebetween. The resistance device 590 is a bungee or elastic cord having a ball 592 secured to each end. Each ball 592 is sized and configured to snap into a downwardly opening support bracket 521-524, with a proximate portion of the cord extending through a respective opening 529. As shown in FIG. 22, the resistance device 590 may be interconnected between an inwardly extending bracket 523 on the left shoe 510*a* and an opposing, inwardly extending bracket 523 on the right shoe 510*b*.

Persons skilled in the art will recognize that the subject present invention may be described in terms of methods with reference to the foregoing embodiments, including methods of making and using same. For example, the present invention may be described in terms of methods of making an exercise shoe assembly, including such a method that comprises the steps of making a shoe body with at least one support bracket integrated into the shoe body; and making a resistance device configured for connection to the support bracket. Such a method may further comprise the step of releasably mounting the resistance device on the support bracket, and/or the resistance device may be made with a housing, a sheave rotatably mounted on the housing, a flexible member wrapped about the sheave, and a rewind spring interconnected between the sheave and the housing in a manner that encourages winding of the flexible member about the sheave.

The present invention may also be described in terms of methods of exercising, including such a method that comprises the steps of selectively connecting a resistance device one's foot and performing a first exercise by extracting a flexible member from the resistance device; and alternatively selectively removing the resistance device from one's foot and performing a second exercise by extracting a flexible member from the resistance device. In such a method, the second exercise may be performed while the resistance device occupies one's hand.

The foregoing description and associated drawings will enable persons skilled in the art to recognize and/or derive various additional embodiments of and/or applications for the present invention. Accordingly, the subject invention should be limited only to the extent of the claims set forth below.

What is claimed is:

1. An exercise shoe assembly, comprising:

a shoe body;

at least one support bracket integrated into the shoe body, wherein the at least one support bracket is configured to define a downwardly opening hook; and a resistance device connected to the support bracket, wherein the resistance device includes a flexible member, and the resistance device is secured beneath the hook in a manner that accommodates upward pulling action on the flexible member.

2. The exercise shoe assembly of claim 1, wherein the resistance device includes a housing, a sheave rotatably mounted inside the housing, and a rewind spring interconnected between the sheave and the housing, wherein the flexible member is wound about the sheave.

3. The exercise shoe assembly of claim 2, wherein the housing is configured to straddle the support bracket.

4. The exercise shoe assembly of claim 2, wherein the support bracket is configured to straddle the housing.

5. The exercise shoe assembly of claim 1, further comprising a removable bracket_interconnected between the support bracket and the resistance device, wherein the removable bracket is releasably latched to the support bracket.

6. The exercise shoe assembly of claim 5, wherein the resistance device is sandwiched between the removable bracket and a portion of the shoe body.

7. The exercise shoe assembly of claim 2, wherein the housing defines an outermost shell that shrouds all sides of the sheave, and the shell_is sized and configured to be held in a person's hand when removed from the shoe.

8. The exercise shoe assembly of claim 5, further comprising a latch movably connected to the support bracket and operable to secure the removable bracket in at least one desired position relative to the support bracket.

9. The exercise shoe assembly of claim 5, wherein the shoe body defines a downwardly opening channel sized and configured to slidably receive a portion of the removable bracket, and the latch includes a key member that cooperates with an opening in the removable bracket to retain the removable bracket in the desired position when occupying a first orientation relative to the shoe body, and to release the removable bracket for movement from the desired position when occupying a discrete, second orientation relative to the shoe body.

10. The exercise shoe assembly of claim 8, wherein a portion of the support bracket is configured to occupy an opening in the removable bracket when the removable bracket occupies the desired position, and the latch is rotatable from a first orientation that accommodates movement of the removable bracket onto said portion, to a second orientation that blocks removal of the removable bracket from said portion.

11. The exercise shoe assembly of claim 8, wherein the latch movably secures the removable bracket in one said desired position forward of the shoe body, and alternatively secures the removable bracket in another said desired position to one side of the shoe body.

12. An exercise shoe assembly, comprising:

a shoe body;

at least one support bracket integrated into the shoe body; and a resistance device connected to the at least one support bracket, wherein the at least one support bracket accommodates the resistance device in at least two operatively discrete positions relative to the shoe body, wherein one of the positions is forward of the shoe body, and another of the positions is to one side of the shoe body.

13. The exercise shoe assembly of claim 12, wherein the resistance device includes a housing, a sheave rotatably mounted inside the housing, a flexible member wrapped around the sheave and having a distal end that is pulled from the housing during exercise, and a rewind spring interconnected between the sheave and the housing in a manner that biases the distal end of the flexible member toward the housing.

14. The exercise shoe assembly of claim 13, wherein the resistance device further includes a brake drum rotatably mounted inside the housing and linked to the sheave in a manner that resists unwinding of the flexible member from the sheave without resisting rewinding of the flexible member onto the sheave.

15. An exercise shoe assembly, comprising:

a shoe body that defines a foot-shaped planform;

a support bracket integrated into the shoe body; and a resistance device connected to the support bracket, wherein one of the resistance device and the support bracket includes a portion disposed outboard from the planform, and the resistance device includes a flexible member that is pulled from a location defined by said portion.

16. The exercise shoe assembly of claim 15, wherein the planform includes a forwardmost toe portion, and said location is disposed a distance forward of the forwardmost toe portion.

17. The exercise shoe assembly of claim 15, wherein the planform includes an outermost sidewall, and said location is disposed a lateral distance apart from the outermost sidewall.

18. The exercise shoe assembly of claim 15, wherein an intermediate bracket is interconnected between the support bracket and the resistance device, and the intermediate bracket is selectively repositionable between a first orientation, extending lengthwise relative to the shoe body, and a second orientation, extending widthwise relative to the shoe body.

19. The exercise shoe assembly of claim 15, wherein the resistance device includes a housing, and said portion is a guide rotatably mounted on the housing.

20. The exercise shoe assembly of claim 19, wherein the resistance device further includes a sheave rotatably mounted inside the housing and a rewind spring interconnected between the sheave and the housing, and the flexible member is wrapped around the sheave and has a distal end that is pulled from the housing during exercise, subject to resistance imparted by the rewind spring.

21. The exercise shoe assembly of claim 12, wherein an intermediate bracket is interconnected between the at least one support bracket and the resistance device, and the intermediate bracket is selectively repositionable relative to the shoe body between a first orientation, supporting the resistance device in one of said desired locations, and a second orientation, supporting the resistance device in a another of said desired locations.

* * * * *